US008836588B2

(12) United States Patent
Hayashi et al.

(10) Patent No.: US 8,836,588 B2
(45) Date of Patent: Sep. 16, 2014

(54) ANTENNA DEVICE AND ELECTRONIC APPARATUS INCLUDING ANTENNA DEVICE

(75) Inventors: Kouji Hayashi, Akishima (JP); Koichi Sato, Tachikawa (JP); Natsumi Endo, Sagamihara (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 176 days.

(21) Appl. No.: 13/533,770

(22) Filed: Jun. 26, 2012

(65) Prior Publication Data

US 2013/0050057 A1 Feb. 28, 2013

(30) Foreign Application Priority Data

Aug. 31, 2011 (JP) ..... 2011-189730

(51) Int. Cl.

| | |
|---|---|
| ***H01Q 1/24*** | (2006.01) |
| ***H01Q 1/38*** | (2006.01) |
| ***H01Q 1/52*** | (2006.01) |
| ***H01Q 21/28*** | (2006.01) |
| ***H01Q 1/48*** | (2006.01) |

(52) U.S. Cl.

CPC ..... *H01Q 21/28* (2013.01); *H01Q 1/38* (2013.01); *H01Q 1/521* (2013.01); *H01Q 1/48* (2013.01)

USPC ..... 343/702; 343/700 MS

(58) Field of Classification Search

USPC ..... 343/702, 700 MS, 846, 848

See application file for complete search history.

(56) References Cited

U.S. PATENT DOCUMENTS

| | | | | |
|---|---|---|---|---|
| 6,738,603 | B1 | 5/2004 | Saito | |
| 7,026,999 | B2 * | 4/2006 | Umehara et al. | 343/702 |
| 7,136,022 | B2 | 11/2006 | Sato et al. | |
| 7,345,637 | B2 | 3/2008 | Mizoguchi et al. | |
| 7,403,160 | B2 * | 7/2008 | Chiang et al. | 343/702 |
| 7,825,859 | B2 | 11/2010 | Teshima | |
| 7,825,861 | B2 | 11/2010 | Sato et al. | |
| 7,885,614 | B2 | 2/2011 | Jedeloo | |

(Continued)

FOREIGN PATENT DOCUMENTS

| | | |
|---|---|---|
| JP | 09-307344 | 11/1997 |
| JP | 1079622 | 3/1998 |

(Continued)

OTHER PUBLICATIONS

European Application No./Patent No. 12167297.6; Extended European Search Report; Mailed Jun. 6, 2013.

(Continued)

*Primary Examiner* — Hoanganh Le

(74) *Attorney, Agent, or Firm* — Blakely, Sokoloff, Taylor & Zafman LLP

(57) ABSTRACT

According to one embodiment, an antenna device according to this embodiment includes first and second feed terminals. The distance between the first and second feed terminals is set to a distance less than or equal to almost one quarter a wavelength corresponding to a predetermined resonant frequency. A first end of the first antenna including a first band, as a communication band, including the resonant frequency is connected to the first feed terminal. A first end of the second antenna including a second band, as a communication band, including at least the resonant frequency of the first antenna is connected to the second feed terminal. A first protruding portion is provided between the first and second antennas so as to protrude from a ground pattern of an antenna board.

15 Claims, 7 Drawing Sheets

(56) References Cited

U.S. PATENT DOCUMENTS

| | | | | |
|---|---|---|---|---|
| 7,965,242 | B2 * | 6/2011 | Abramov et al. | 343/702 |
| 2003/0193437 | A1 | 10/2003 | Kangasvieri et al. | |
| 2004/0108957 | A1 | 6/2004 | Umehara et al. | |
| 2005/0094530 | A1 | 5/2005 | Nakagawa et al. | |
| 2005/0153756 | A1 | 7/2005 | Sato et al. | |
| 2007/0164920 | A1 * | 7/2007 | Chen | 343/795 |
| 2007/0229366 | A1 | 10/2007 | Kim et al. | |
| 2008/0169981 | A1 | 7/2008 | Hotta et al. | |
| 2008/0258992 | A1 * | 10/2008 | Tsai et al. | 343/853 |
| 2009/0027286 | A1 | 1/2009 | Ohishi et al. | |
| 2009/0115388 | A1 | 5/2009 | Miyazaki et al. | |
| 2009/0174611 | A1 * | 7/2009 | Schlub et al. | 343/702 |
| 2009/0231213 | A1 | 9/2009 | Ishimiya | |
| 2010/0026596 | A1 | 2/2010 | Nishio et al. | |
| 2010/0156745 | A1 | 6/2010 | Andrenko et al. | |
| 2010/0194658 | A1 | 8/2010 | Yukimoto et al. | |
| 2010/0214181 | A1 | 8/2010 | Ryou et al. | |
| 2011/0074638 | A1 | 3/2011 | Gong et al. | |
| 2011/0183633 | A1 | 7/2011 | Ohba et al. | |
| 2013/0050036 | A1 | 2/2013 | Kashiwagi et al. | |

FOREIGN PATENT DOCUMENTS

| | | |
|---|---|---|
| JP | 2003273643 | 9/2003 |
| JP | 2004-023369 | 1/2004 |
| JP | 2004-201278 | 7/2004 |
| JP | 2005-203878 | 7/2005 |
| JP | 2005-295493 | 10/2005 |
| JP | 2006-042111 | 2/2006 |
| JP | 2006-101486 | 4/2006 |
| JP | 2006-166994 | 6/2006 |
| JP | 2006-196994 | 7/2006 |
| JP | 2006-279530 | 10/2006 |
| JP | 2007-123982 | 5/2007 |
| JP | 2007-142895 | 6/2007 |
| JP | 2008-28734 | 2/2008 |
| JP | 2008-160411 | 7/2008 |
| JP | 2008-177668 | 7/2008 |
| JP | 2008-199688 | 8/2008 |
| JP | 2008-271468 | 11/2008 |
| JP | 2008-283464 | 11/2008 |
| JP | 2008-283493 | 11/2008 |
| JP | 2009-033548 | 2/2009 |
| JP | 2009-246560 | 10/2009 |
| JP | 2010-41071 | 2/2010 |
| JP | 2010-153973 | 7/2010 |
| JP | 2010-526471 | 7/2010 |
| JP | 2011-519542 | 7/2011 |
| WO | WO 2008-013021 | 1/2008 |

OTHER PUBLICATIONS

European Application No./Patent No. 12167297.6; Extended European Search Report; Mailed Jun. 10, 2013.

Japanese Patent Application No. 2011-189730, First Office Action, mailed Jul. 31, 2012, (with English Translation).

European Patent Application No. 12167297.6, European Search Report, mailed Dec. 21, 2012, (Reference No. 1967/EL).

Jiunn-Nan Hwang et al: "Isolation Enhancement Between Two Packed Antennas With Coupling Element", IEEE Antennas and Wireless Propagation Letters, IEEE, Piscataway, NJ, US, vol. 10, Jan. 1, 2011, pp. 1263-1266, XP11403146, ISSN: 1536-1225, DOI: 10.1109/LAWP.2011.2174957.

Shuai Zhang et al: "Ultrawideband MIMO/Diversity Antennas With a Tree-Like Structure to Enhance Wideband Isolation", IEEE Antennas and Wireless Propagation Letter, IEEE, Piscataway, NJ, US, vol. 8, Jan. 1, 2009, pp. 1279-1282, XP011331166, ISSN: 1536-1225, DOI: 10.1109/LAWP.2009.2037027.

Andrenko A S et al: "Low Correlation Antenna Design for Diversity Handset Applications", Microwave Conference, 2008. APMC 2008. Asia-Pacific, IEEE, Piscataway, NJ, USA, Dec. 16, 2008, pp. 1-4, XP031637073, ISBN: 978-1-4244-2641-6.

Cui S et al: "Compact dual-Band Monopole Antennas with High Port Isolation", Electronic Letters, The Institution of Engineering and Technology, vol. 47, No. 10, May 12, 2011, pp. 579-580, XP006038874, ISSN: 1350-911X, DOI: 10.1049/EL:20103603.

* cited by examiner

ANTENNA DEVICE AND ELECTRONIC APPARATUS INCLUDING ANTENNA DEVICE

CROSS-REFERENCE TO RELATED APPLICATIONS

This application is based upon and claims the benefit of priority from prior Japanese Patent Application No. 2011-189730, filed Aug. 31, 2011, the entire contents of which are incorporated herein by reference.

FIELD

Embodiments described herein relate generally to an antenna device and an electronic apparatus including the antenna device.

BACKGROUND

Various kinds of electronic apparatuses have been developed, wherein personal computers and television receivers are able to incorporate radio interfaces using a wireless local area network (LAN), WiMAX®, ultra-wideband (UWB), Bluetooth®, and the like to download content and various kinds of data from Web sites and the like via the radio interfaces.

The antenna device used in the above radio interface generally includes two antennas to obtain a diversity effect. For this reason, when an electronic apparatus is to accommodate an antenna device, the device needs to ensure a wider accommodation space than when using one antenna. On the other hand, an electronic apparatus such as a personal computer has a limited surplus space in the housing due to a reduction in the thickness of the housing and high-density packing of circuit components. For this reason, when accommodating an antenna device in an electronic apparatus, the two antennas are inevitably located close to each other. If, however, the two antennas are close to each other, the interference between the antennas becomes large. This may lead to inability to obtain desired antenna performance.

Under the circumstances, there has been proposed an antenna device which provides a notch in a ground pattern at a position between the two antennas to prevent the propagation of a high-frequency signal between the antennas. There has also been proposed an antenna device which provides slits, respectively, at positions on a ground pattern which correspond to the two antennas and also provides a stub at a position on the ground pattern which corresponds to the symmetry axis between the two antennas so as to reduce mutual coupling between the antennas.

These conventionally proposed antenna devices each are configured to cancel out high-frequency currents transmitted between the feed terminals of the two antennas by using an open stub. This makes it necessary to form, in the ground pattern, a notch, slit, and the like whose dimensions are strictly defined, leading to the need to take time and effort for processing and a complicated, large-sized structure. In addition, when wiring feed cables and the like, the notch provided in the ground pattern may be short-circuited, resulting in a deterioration in reliability.

BRIEF DESCRIPTION OF THE DRAWINGS

A general architecture that implements the various features of the embodiments will now be described with reference to the drawings. The drawings and the associated descriptions are provided to illustrate the embodiments and not to limit the scope of the invention.

DETAILED DESCRIPTION

Various embodiments will be described hereinafter with reference to the accompanying drawings.

In general, according to one embodiment, an antenna device of the embodiment includes first and second feed terminals on an antenna board on which a ground pattern is formed. The distance between the first and second feed terminals is set to a distance less than or equal to almost one quarter a wavelength corresponding to a predetermined resonant frequency. A first end of the first antenna including a first band, as a communication band, including the resonant frequency is connected to the first feed terminal. A first end of the second antenna including a second band, as a communication band, including at least the resonant frequency of the first antenna is connected to the second feed terminal. A first protruding portion is provided between the first and second antennas so as to protrude from the ground pattern of the antenna board. The first protruding portion has a function of bypassing part of a current flowing between the first and second feed terminals via the ground pattern.

First Embodiment

Figure 1:
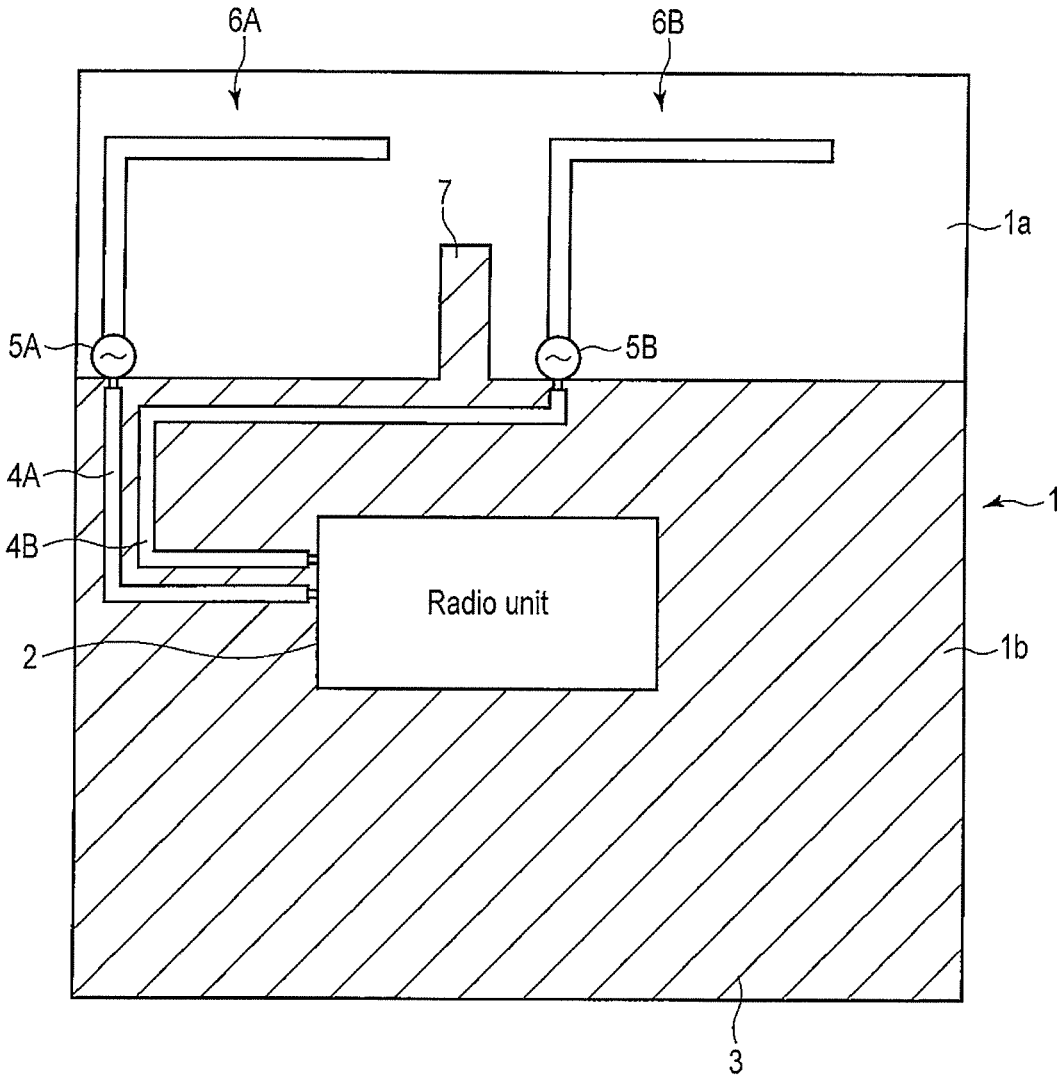
FIG. 1 is a view showing the arrangement of an electronic apparatus including an antenna device according to the first embodiment.

FIG. 1 is a view showing the arrangement of the main part of an electronic apparatus including an antenna device according to the first embodiment. This electronic apparatus is formed from a notebook computer or television receiver including a radio interface, and has a printed circuit board 1 accommodated in the housing (not shown).

Note that the electronic apparatus may be a portable terminal such as a navigation terminal, cellular phone, smart phone, personal digital assistant (PDA), or tablet computer instead of a notebook computer or television receiver. In addition, the printed circuit board 1 may be the one using part of a metal housing or a metal member such as a copper foil or may be a multilayer board.

The printed circuit board 1 described above includes a first area 1*a* and a second area 1*b*. The antenna device is provided in the first area 1*a*. A ground pattern 3 is formed in the second area 1*b*. A plurality of circuit modules necessary to form the electronic apparatus are mounted on the lower surface side of the printed circuit board 1. The circuit modules include a radio unit 2. The radio unit 2 has a function of transmitting and receiving radio signals by using the frequency band assigned to a radio system as a communication target.

In the first area 1*a*, a first feed terminal 5A is provided at a position corresponding to near a corner portion of the ground pattern 3, and a second feed terminal 5B is provided at a position corresponding to the middle portion of the ground pattern 3. The feed terminals 5A and 5B are connected to the radio unit 2 via feed cables 4A and 4B. The feed cables 4A and 4B are formed from coaxial cables including cores covered with shield wires, and are wired along the sides of the ground pattern 3. The reason is to prevent these cables from imposing adverse effects on circuit modules and the like mounted on the printed circuit board 1, for example, imposing a limitation on the mounting space.

The antenna device has the following arrangement.

That is, the antenna device includes a first antenna 6A and a second antenna 6B. The antennas 6A and 6B each are formed from an L-shaped monopole element, and are disposed such that horizontal portions parallel to the ground pattern 3 face the same direction. One end of the first and second antennas 6A and 6B each are connected to the first and second feed terminal. The first and second antennas 6A and 6B cover the same frequency band of the radio system to obtain a diversity effect.

A convex portion 7 as the first protruding portion in a strip shape is provided between the first and second antennas 6A and 6B in the first area 1*a*. The convex portion 7 is formed by extending a portion of the ground pattern 3 into the first area 1*a* so as to be parallel to a vertical portion of the second antenna 6B.

Figure 2:
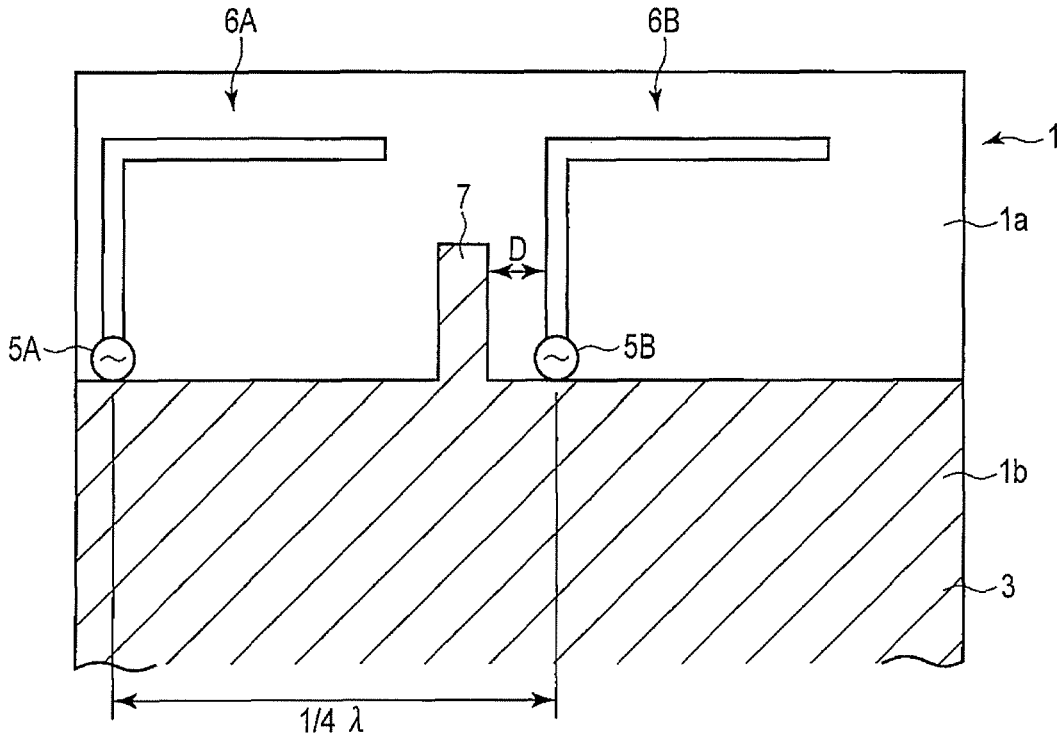
FIG. 2 is a view showing an embodiment of the antenna device shown in FIG. 1.

FIG. 2 is a view showing a specific disposition relationship in the above antenna device. Referring to FIG. 2, the disposition interval between the first and second feed terminals 5A and 5B is set to almost one quarter a wavelength corresponding to the resonant frequency of the first and second antennas 6A and 6B. Note that this disposition interval need not be limited to one quarter the wavelength, and can be set to an arbitrary value less than or equal to one quarter the wavelength.

Figure 5:
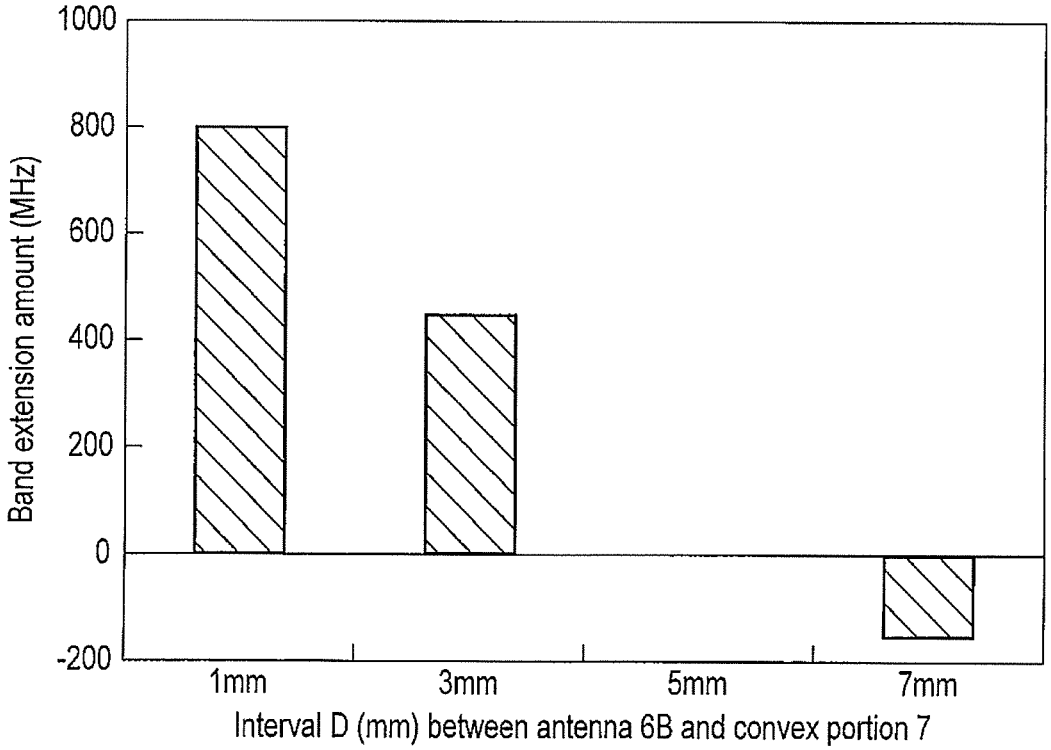
FIG. 5 is a graph showing the relationship between the band extension amount and the interval between a second antenna and a convex portion in the antenna device shown in FIG. 2.

In addition, an interval D between the convex portion 7 and the portion of the second antenna 6B which is perpendicular to the ground pattern 3 of the second antenna 6B is set less than or equal to one tenth the wavelength corresponding to the resonant frequency of the first and second antennas 6A and 6B. Setting the interval D in this manner will make the convex portion 7 operate as a parasitic element with respect to the second antenna 6B. This makes it possible to extend the resonant bandwidth of the second antenna 6B as compared with a case in which the second antenna 6B is singly used. FIG. 5 shows an example of the analysis result. FIG. 5 shows the relationship between the interval D and the band extension amount (MHz) at a resonant frequency of 5,850 MHz. As is obvious from FIG. 5, setting the interval D to less than or equal to one tenth a wavelength corresponding to the above resonant frequency, that is, less than or equal to 5 mm, will extend the resonant bandwidth.

Figure 3:
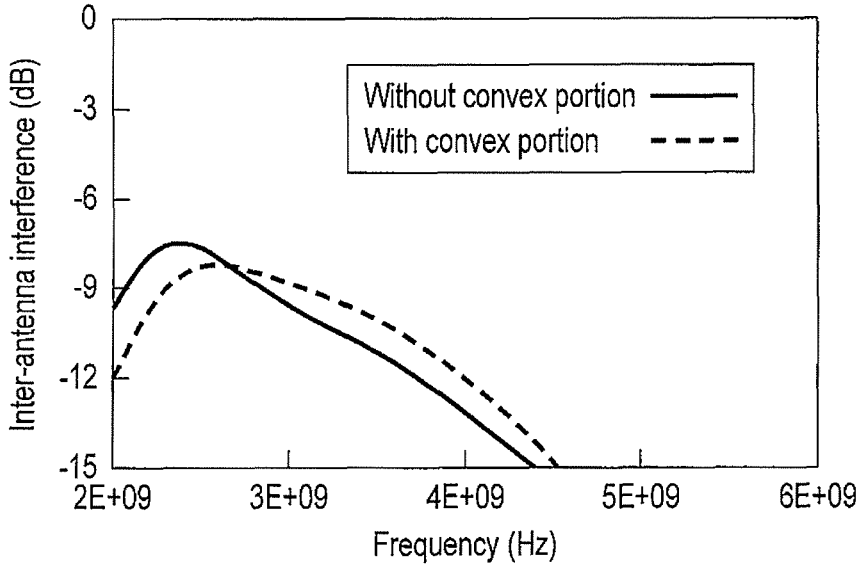
FIG. 3 is a graph showing the frequency characteristics of inter-antenna interference in the antenna device shown in FIG. 2.

According to the antenna device including the above arrangement, providing the convex portion 7 near the second antenna 6B between the first and second antennas 6A and 6B will change the distribution of currents flowing in the ground pattern 3. This reduces the amount of high-frequency current flowing into the feed terminals 5B and 5A between the first and second feed terminals 5A and 5B, resulting in a reduction in mutual interference between the first and second antennas 6A and 6B. FIG. 3 is a graph showing changes in the magnitude of inter-antenna interference with changes in frequency. As is obvious from FIG. 3, providing the convex portion 7 can suppress the maximum inter-antenna interference in a low-frequency region.

Figure 4:
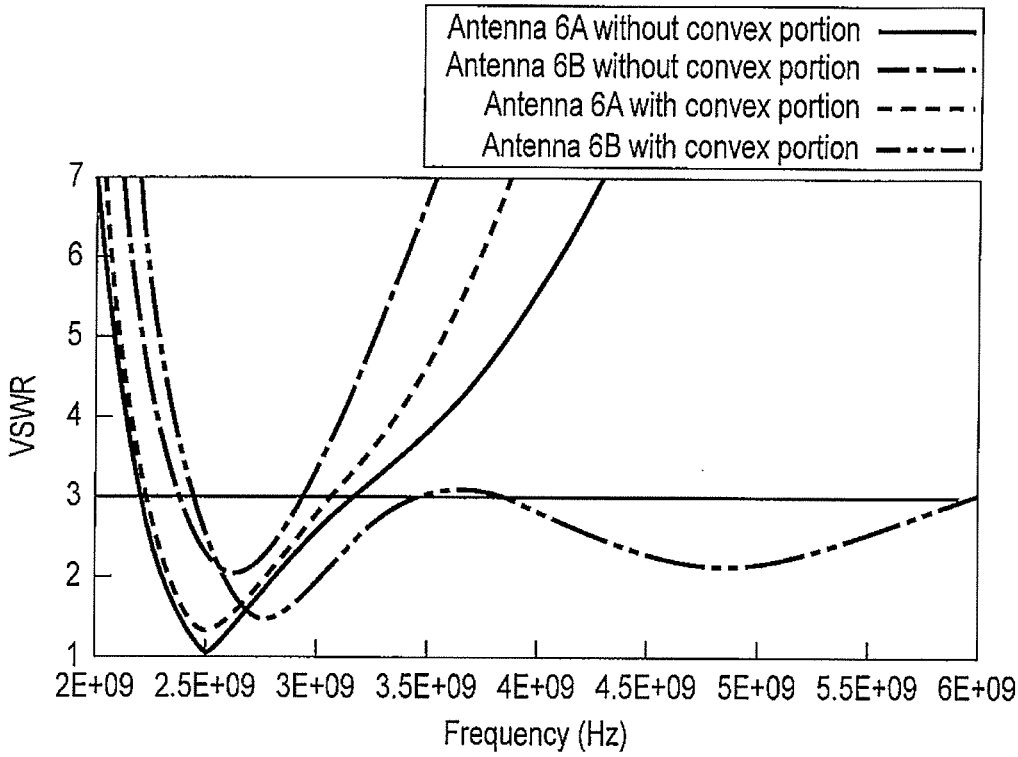
FIG. 4 is a graph showing the VSWR frequency characteristics of the respective antennas of the antenna device shown in FIG. 2.

In addition, the first embodiment can achieve extension of the resonant band. FIG. 4 is a graph showing the results obtained by analyzing the frequency characteristics of voltage standing wave ratios (VSWRs) of the first and second antennas 6A and 6B before and after the convex portion 7 is provided. As shown in FIG. 4, with the first antenna 6A, the characteristics obtained after the convex portion 7 is provided are almost the same as those obtained before the convex portion 7 is provided. In contrast to this, with the second antenna 6B, providing the convex portion 7 can greatly extend the resonant band in the intermediate-frequency region and the high-frequency region as compared with before the convex portion 7 is provided.

As described in detail above, in the first embodiment, the first and second antennas 6A and 6B formed from L-shaped monopole elements are disposed such that the interval between the first and second feed terminals 5A and 5B is set to fall within one quarter the wavelength corresponding to the resonant frequency, and the horizontal portions parallel to the ground pattern 3 face the same direction. The convex portion 7 extending from the ground pattern 3 is disposed at a position near the second antenna 6B between the first and second antennas 6A and 6B, for example, at a position corresponding to a wavelength less than or equal to one tenth the wavelength corresponding to the resonant frequency.

Providing the convex portion 7 therefore will change the distribution of currents flowing in the ground pattern 3. This will reduce the amount of high-frequency current flowing into the feed terminals 5B and 5A between the first and second feed terminals 5A and 5B. This can therefore reduce the mutual interference between the first and second antennas 6A and 6B. That is, the simple arrangement obtained by only providing the convex portion 7 between the first and second antennas 6A and 6B can improve the isolation characteristic between the first and second antennas 6A and 6B.

In addition, since the convex portion 7 is disposed at a position near the second antenna 6B, for example, at a position corresponding to a wavelength within one tenth the wavelength corresponding to the resonant frequency from the second feed terminal 5B, it is possible to make the convex portion 7 operate as a parasitic element of the second antenna 6B. This can extend the band of the antenna device by extending the resonant band of the second antenna 6B.

In addition, the horizontal portions of the first and second antennas 6A and 6B which are parallel to the ground pattern 3 face the same direction, and the first feed terminal 5A is provided near a corner portion of the ground pattern 3, while the second feed terminal 5B is provided at a position corresponding to the middle portion of the ground pattern 3. Even if, therefore, the feed cables 4A and 4B are wired along the sides of the ground pattern 3, it is possible to reduce the zone where the feed cables 4A and 4B are close and parallel to the horizontal portions of the first and second antennas 6A and 6B. In addition, it is possible to separate the feed cable 4B from the first antenna 6A by the outer diameter of the feed cable 4A in the zone where they are parallel to each other. This can reduce the adverse effects of the feed cables 4A and 4B on the first antenna 6A.

Second Embodiment

Figure 6:
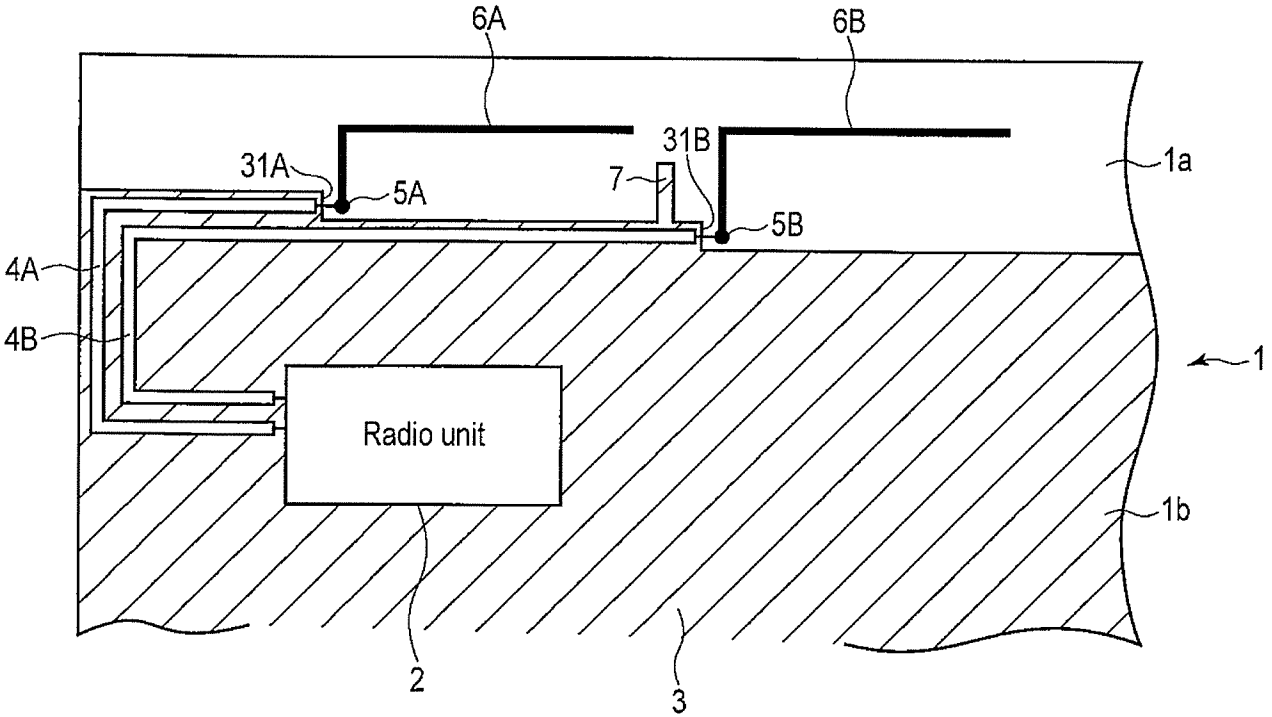
FIG. 6 is a view showing the arrangement of an electronic apparatus including an antenna device according to the second embodiment.

FIG. 6 is a view showing the arrangement of an antenna device according to the second embodiment. The same reference numerals as in FIG. 1 denote the same parts in FIG. 6, and a detailed description of them will be omitted.

A ground pattern 3 formed on a printed circuit board 1 is formed in a staircase pattern such that a side in contact with a first area 1*a* has stepped portions at two portions 31A and 31B. Feed cables 4A and 4B are wired, along the sides of the ground pattern 3, from a radio unit 2 to the portions 31A and 31B at which the stepped portions are formed. The cores of the feed cables 4A and 4B are respectively connected to feed terminals 5A and 5B provided near the portions 31A and 31B at which the stepped portions on the first area 1*a* are formed. The shield wires of the feed cables 4A and 4B are connected to the ground pattern 3 at the portions 31A and 31B at which the stepped portions are formed. Note that as a connection means for the cores and shield wires described above, for example, soldering is used.

One end portion of each of first and second antennas 6A and 6B, each formed from an L-shaped monopole element, is connected to a corresponding one of the feed terminals 5A and 5B. The first and second antennas 6A and 6B are arranged such that the horizontal portions parallel to the ground pattern 3 face the same direction. A protruding portion (convex portion) 7 in a strip shape is formed, by extending a portion of the ground pattern 3 parallel to a vertical portion of the second antenna 6B, near the portion 31B of the ground pattern 3 at which the stepped portion is formed. An interval D between the convex portion 7 and the vertical portion of the second antenna 6B is set less than or equal to one tenth the wavelength corresponding to the resonant frequency of the first and second antennas 6A and 6B.

According to the second embodiment, providing the convex portion 7 near the second antenna 6B between the first and second antennas 6A and 6B can improve the isolation characteristic between the antennas 6A and 6B with a very simple arrangement as described in the first embodiment, thereby reducing the interference between the antennas 6A and 6B.

Since the convex portion 7 is provided near the second antenna 6B, for example, at a position corresponding to a wavelength falling within one tenth the wavelength corresponding to the resonant frequency from the feed terminal 5B, the convex portion 7 can operate as a parasitic element of the second antenna 6B. This makes it possible to extend the resonant band of the second antenna 6B, thereby achieving extension of the band of the antenna device.

In addition, forming a side of the ground pattern 3 into a staircase pattern to have stepped portions at the two portions 31A and 31B allows the feed cables 4A and 4B to be arranged along the sides of the ground pattern 3 without bending them into an unnatural shape, thereby improving the reliability of the antenna device and electronic apparatus. Furthermore, wiring the feed cables 4A and 4B along the sides of the printed circuit board 1 can improve the mounting efficiency of electronic apparatuses and circuit modules per unit area by effectively using the mounting space of the printed circuit board 1.

Third Embodiment

Figure 7:
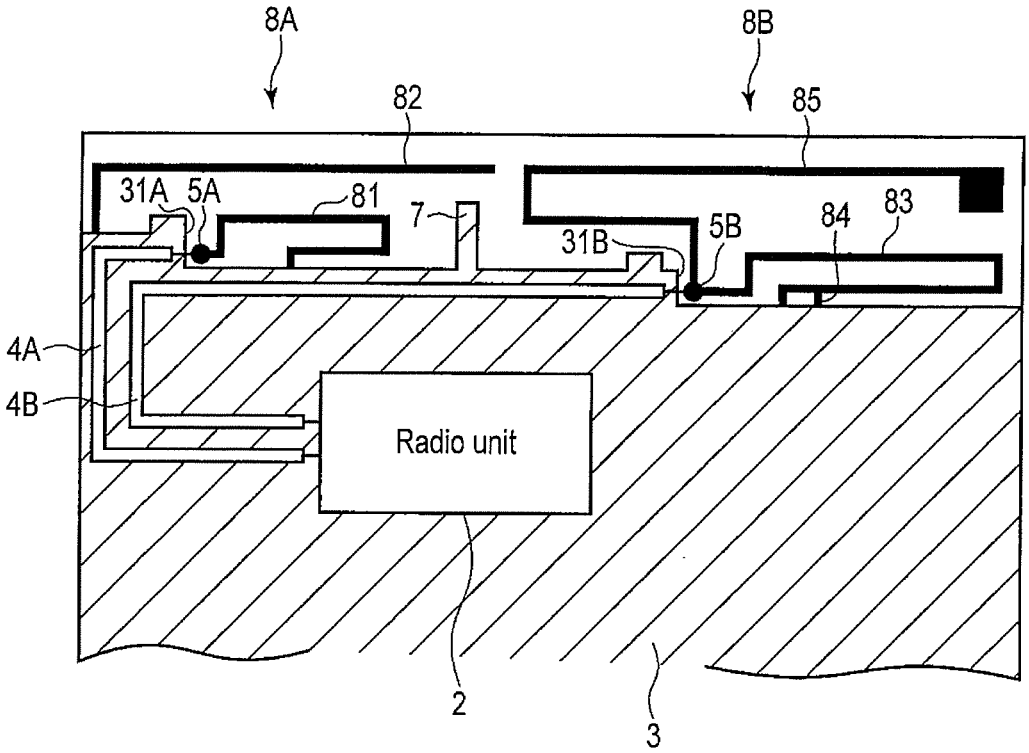
FIG. 7 is a view showing the arrangement of an electronic apparatus including an antenna device according to the third embodiment.

FIG. 7 is a view showing the arrangement of an electronic apparatus including an antenna device according to the third embodiment. The same reference numerals as in FIG. 6 denote the same parts in FIG. 7, and a detailed description of them will be omitted.

A ground pattern 3 formed on a printed circuit board 1 is formed in a staircase pattern such that a side in contact with a first area 1*a* has stepped portions at two portions 31A and 31B. Feed cables 4A and 4B are wired, along the sides of the ground pattern 3, from a radio unit 2 to the portions 31A and 31B at which the stepped portions are formed. The cores of the feed cables 4A and 4B are respectively connected to feed terminals 5A and 5B provided near the portions 31A and 31B at which the stepped portions on the first area 1*a* are formed.

On the other hand, the antenna device includes first and second antennas 8A and 8B each formed by combining a plurality of antenna elements. The first antenna 8A includes a folded monopole element 81 and an L-shaped parasitic element 82. The folded monopole element 81 has one end connected to the first feed terminal 5A, and the other end connected to the ground pattern 3. The parasitic element 82 has a proximal end connected to the ground pattern 3 near the first feed terminal 5A, and a horizontal portion disposed above the folded monopole element 81.

The second antenna 8B includes a folded monopole element 83 with a stub 84 and a monopole element 85. The folded monopole element 83 with the stub has one end connected to the second feed terminal 5B, and the other end connected to the ground pattern 3. The monopole element 85 has a proximal end connected to the second feed terminal 5B, and the other end open.

In the first area 1*a* of the printed circuit board 1, a convex portion 7 as the second protruding portion is provided at a position between the first and second antennas 8A and 8B. As in the first and second embodiments, the convex portion 7 is formed from a conductive pattern in a strip shape obtained by extending a portion of the ground pattern 3 in the vertical direction. An interval D between the convex portion 7 and the second feed terminal 5B is set less than or equal to one tenth the wavelength corresponding to the resonant frequency of the first and second antennas 8A and 8B.

Figure 8:
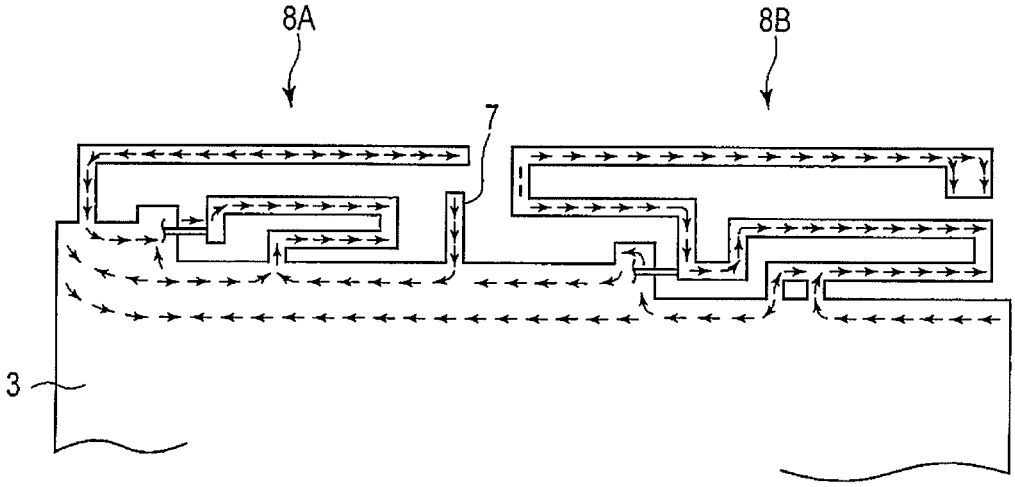
FIG. 8 is a view showing an example of a current distribution in the antenna device shown in FIG. 7.

As described above, in the third embodiment, the convex portion 7 is provided at a position near the second antenna 8B between the first and second antennas 8A and 8B, for example, a position corresponding to the wavelength within one tenth the wavelength corresponding to the resonant frequency. This changes the distribution of high-frequency currents flowing on the ground pattern 3 as shown in FIG. 8, thereby reducing the current flowing between the feed terminals 5A and 58. This can therefore reduce the mutual interference between the first and second antennas 8A and 88 and improve the isolation characteristic between the antennas 8A and 8B. As a consequence, it is possible to obtain characteristics similar to those obtained by singly providing the first antenna 8A.

Figure 9:
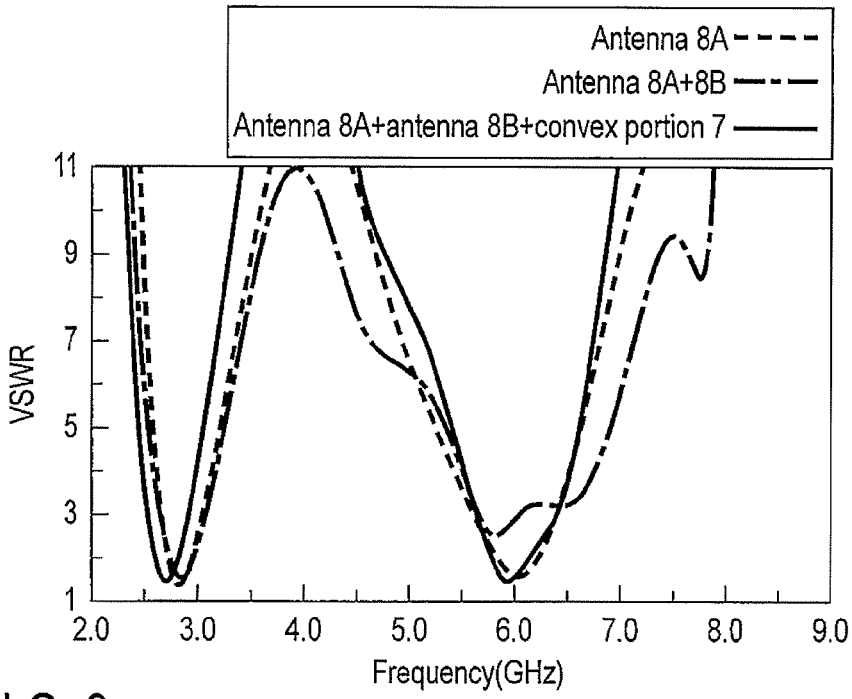
FIG. 9 is a graph showing VSWR frequency characteristics in the antenna device shown in FIG. 7.

FIG. 9 is a graph showing the comparisons between the VSWR frequency characteristics obtained when the convex portion 7 is provided between the first and second antennas 8A and 8B, those obtained when the convex portion 7 is not provided, and those obtained when the first antenna 8A is singly provided. As is obvious from FIG. 9, providing the convex portion 7 can improve the isolation characteristic between the first and second antennas 8A and 8B and obtain characteristics similar to those obtained when the first antenna 8A is singly provided.

Since the convex portion 7 is provided near the second antenna 8B, for example, at a position corresponding to a wavelength falling within one tenth the wavelength corresponding to the resonant frequency from the feed terminal 5B, the convex portion 7 can operate as a parasitic element of the second antenna 8B. This makes it possible to extend the resonant band of the second antenna 8B, thereby achieving extension of the band of the antenna device.

In addition, forming a side of the ground pattern 3 into a staircase pattern to have stepped portions at the two portions 31A and 31B allows the feed cables 4A and 4B to be arranged along the sides of the ground pattern 3 without bending them into an unnatural shape, thereby improving the reliability of the antenna device and electronic apparatus. Furthermore, wiring the feed cables 4A and 4B along the sides of the printed circuit board 1 can improve the mounting efficiency of electronic apparatuses and circuit modules per unit area by effectively using the mounting space of the printed circuit board 1.

Fourth Embodiment

Figure 10:
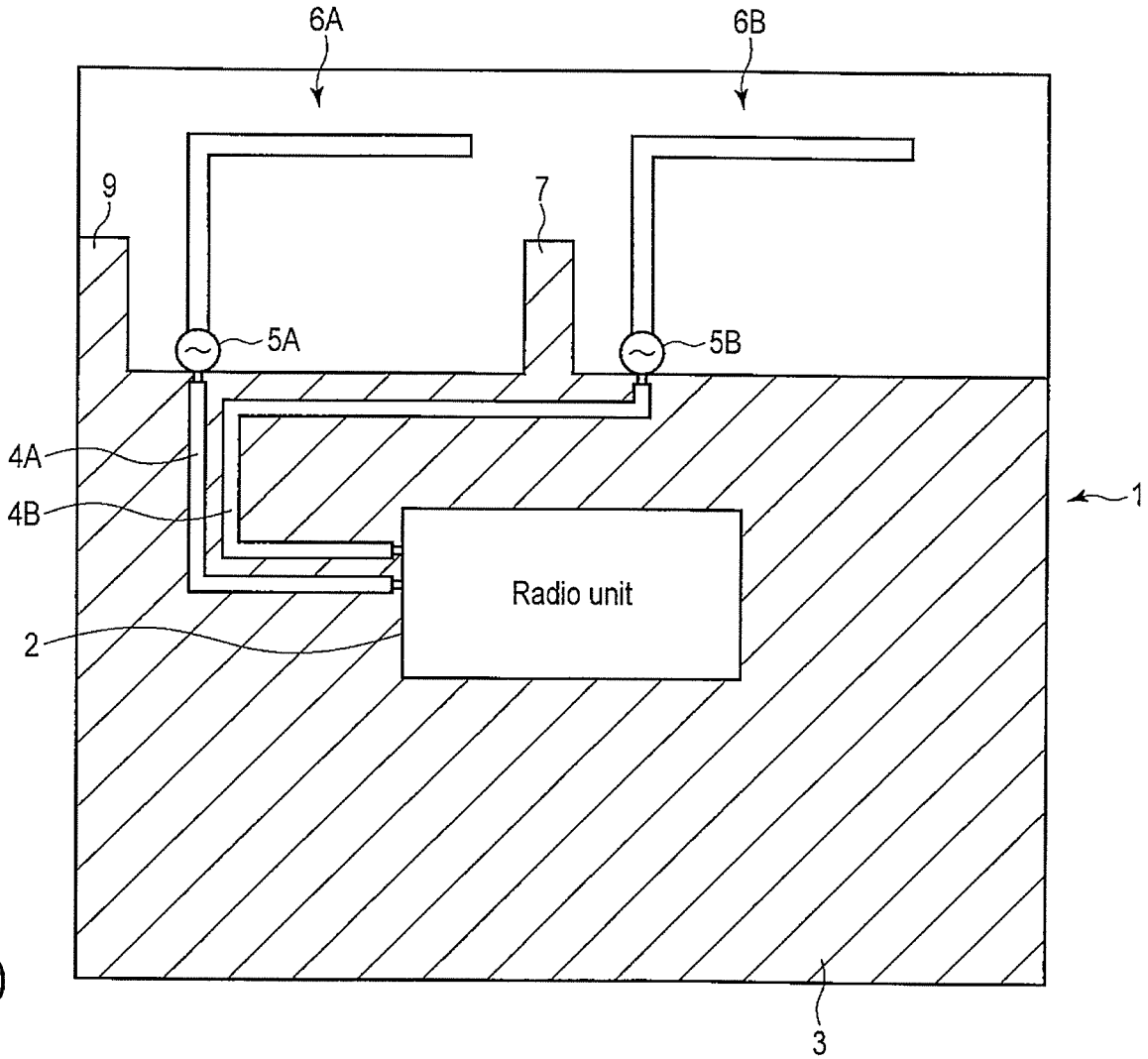
FIG. 10 is a view showing the arrangement of an electronic apparatus including an antenna device according to the fourth embodiment.

FIG. 10 is a view showing the arrangement of an electronic apparatus including an antenna device according to the fourth embodiment. The same reference numerals as in FIG. 1 denote the same parts in FIG. 10, and a detailed description of them will be omitted.

In a first area 1*a* of a printed circuit board 1, a convex portion 7 as the second protruding portion is provided between first and second antennas 6A and 6B, as described in the first embodiment. In addition, a convex portion 9 as the second protruding portion is provided on a side of the first antenna 6A on which the second antenna 6B is not disposed. The convex portions 7 and 9 each are formed from a conductive pattern in a strip shape formed by extending a portion of a ground pattern 3 into the first area 1*a*, and are formed parallel to the vertical portions of the second and first antennas 6B and 6A. The interval between the convex portion 9 and the vertical portion of the first antenna 6A is set less than or equal to one tenth the wavelength corresponding to the resonant frequency of the first and second antennas 6A and 6B, like the interval between the convex portion 7 and the vertical portion of the second antenna 6B.

With this arrangement, providing the convex portion 7 near the second antenna 6B between the first and second antennas 6A and 6B will change the distribution of currents flowing in the ground pattern 3. This will reduce the amount of high-frequency current flowing into feed terminals 5B and 5A between the first and second feed terminals 5A and 5B. This can therefore reduce the mutual interference between the first and second antennas 6A and 6B. In addition, providing the convex portion 9 near the first antenna 6A makes the convex portion 9 operate as a parasitic element with respect to the first antenna 6A. This can extend the resonant band of the first antenna 6A.

Figure 11:
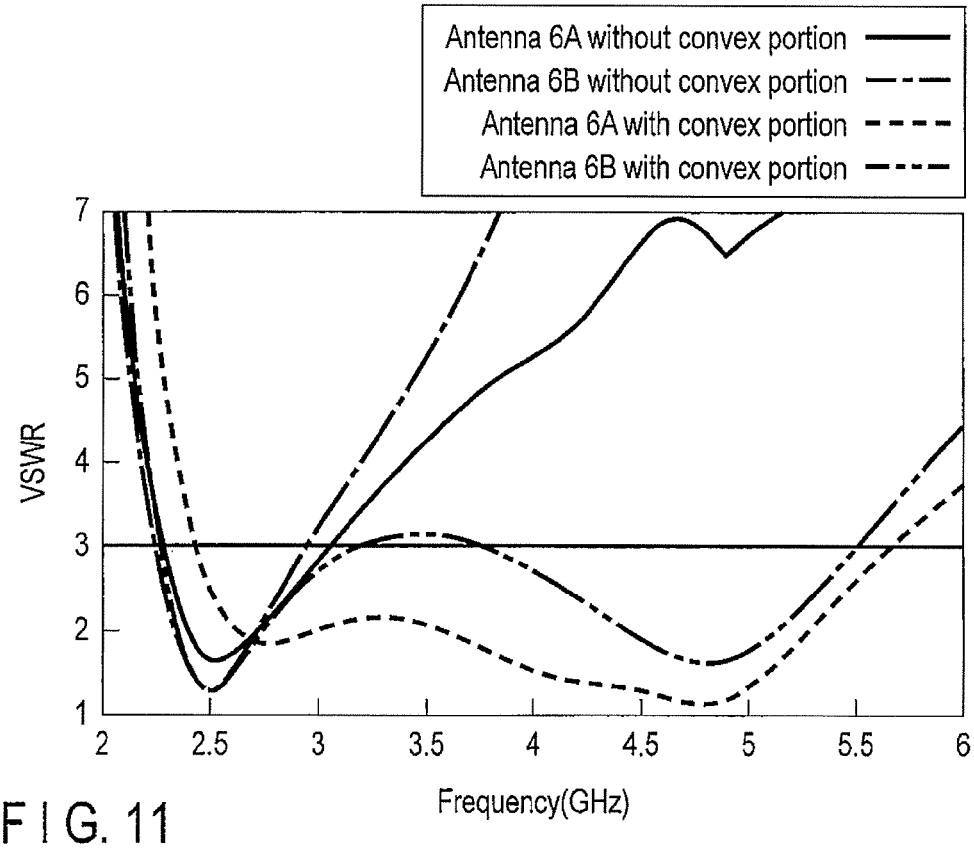
FIG. 11 is a graph showing the VSWR frequency characteristics of the respective antennas of the antenna device shown in FIG. 10.

FIG. 11 shows the comparison between the VSWR frequency characteristics of the second antenna 6B with the convex portion 7 and the first antenna 6A with the convex portion 9 and those obtained when the convex portions 7 and 9 are not provided. As shown in FIG. 11, providing the convex portions 7 and 9 can extend both the resonant bands of the first and second antennas 6A and 6B in the high-frequency direction.

Other Embodiments

Each embodiment described above has exemplified the case in which the horizontal portions of the first and second antennas face the same direction. However, each embodiment is not limited to this, and the horizontal portions may be arranged to face opposite directions, that is, the first and second antennas may be arranged symmetrically. In this case, if the first and second feed cables are bundled and wired along the sides of the ground pattern, the horizontal portion of the first antenna becomes parallel to the first feed cable in some zone. As a consequence, the cable has an influence on the first antenna. However, the convex portion 7 provided between the first and second antennas suppresses the interference between the first and second antennas.

In addition, each embodiment can be executed by variously modifying the types and arrangements of the first and second antennas, the shapes and installation positions of protruding portions, the wiring structure of feed cables, the type and arrangement of the electronic apparatus, and the like.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An antenna device comprising:

an antenna board on which a ground pattern is formed;

a first feed terminal provided on the antenna board;

a substantially L-shaped first antenna including a first straight portion which is substantially elongated in a first direction from a first end connected to the first feed terminal to a first connecting portion, and a second straight portion which is substantially elongated along a second direction from the first connecting portion to a second end opened, the first antenna being operable in a first band, as a communication band, which includes a predetermined resonant frequency;

a second feed terminal provided on the antenna board at a distance not more than substantially one quarter a wavelength corresponding to the resonant frequency of the first antenna from the first feed terminal;

a substantially L-shaped second antenna including a third straight portion which is substantially elongated in the first direction from a third end connected to the second feed terminal to a second connecting portion, and a fourth straight portion which is substantially elongated along the second direction from the second connecting portion to a fourth end opened, the second antenna being operable in a second band, as a communication band, which includes at least the resonant frequency of the first antenna; and a first protruding portion which is provided at a position between the first antenna and the second antenna so as to protrude from the ground pattern of the antenna board along the first direction, and bypasses part of a current flowing through the ground pattern between the first feed terminal and the second feed terminal, wherein the first antenna is so located as to have a first distance between the first straight portion and the first protruding portion, the second antenna is so located as to have a second distance between the third straight portion and the first protruding portion, which is shorter than the first distance, and the second distance is less than or equal to one tenth a wavelength corresponding to the resonant frequency from the second antenna.

2. The device of claim 1, wherein the first feed terminal is disposed near a corner portion of the ground pattern on the antenna board, the second feed terminal is disposed at a position on the antenna board which corresponds to a middle portion of the ground pattern, and the second straight portion of the first antenna and the fourth straight portion of the second antenna are arranged as to be parallel to one side edge of the ground pattern and the second straight portion of the first antenna and the fourth straight portion of the second antenna are directed in the second direction from the first and second connecting portions, respectively.

3. The device of claim 1, further comprising a second protruding portion which is provided at a position on a side of the first antenna which is opposite to the second antenna so as to protrude from the ground pattern of the antenna board, and operates as a parasitic element with respect to the first antenna.

4. The device of claim 3, wherein the second protruding portion is disposed at a distance not more than substantially one tenth a wavelength corresponding to the resonant frequency from the first antenna.

5. The apparatus of claim 1, further comprising:

a first feed cable which is connected to the first feed terminal and is arranged on the ground pattern, and a second feed cable which is connected to the second feed terminal, is arranged on the ground pattern so as to be extended along one side edge of the ground pattern in a third direction opposite to the second direction to the first feed cable and have an elongated portion in parallel with the first feed cable.

6. An electronic apparatus comprising:

a housing;

a radio circuit accommodated in the housing; and an antenna device accommodated in the housing, the antenna device comprising an antenna board on which a ground pattern is formed, a first feed terminal provided on the antenna board and connected to the radio circuit via a first feed cable having a portion extending along an side of the antenna board, a substantially L-shaped first antenna including a first straight portion which is substantially elongated in a first direction from a first end connected to the first feed terminal to a first connecting portion, and a second straight portion which is substantially elongated along a second direction from the first connecting portion to a second end opened, the first antenna being operable in a first band, as a communication band, which includes a predetermined resonant frequency, a second feed terminal provided on the antenna board at a distance not more than substantially one quarter a wavelength corresponding to the resonant frequency of the first antenna from the first feed terminal and connected to the radio circuit via a second feed cable having a portion extending along an side of the antenna board;

a substantially L-shaped second antenna including a third straight portion which is substantially elongated in the first direction from a first end connected to the second feed terminal to a second connecting portion, and a fourth straight portion which is substantially elongated along the second direction from the second connecting portion to a fourth end opened, the second antenna being operable in a second band, as a communication band, which includes at least the resonant frequency of the first antenna; and a first protruding portion which is provided at a position between the first antenna and the second antenna so as to protrude from the ground pattern of the antenna board along the first direction, and bypasses part of a current flowing through the ground pattern between the first feed terminal and the second feed terminal, wherein the first antenna is so located as to have a first distance between the first straight portion and the first protruding portion, the second antenna is so located as to have a second distance between the third straight portion and the first protruding portion, which is shorter than the first distance, and the second distance is less than or equal to one tenth a wavelength corresponding to the resonant frequency from the second antenna.

7. The apparatus of claim 6, wherein the first feed terminal is disposed near a corner portion of the ground pattern on the antenna board, the second feed terminal is disposed at a position on the antenna board which corresponds to a middle portion of the ground pattern, and the second straight portion of the first antenna and the fourth straight portion of the second antenna are arranged as to be parallel to one side edge of the ground pattern and the second straight portion of the first antenna and the fourth straight portion of the second antenna are directed in the second direction from the first and second connecting portions, respectively.

8. The apparatus of claim 6, further comprising a second protruding portion which is provided at a position on a side of the first antenna which is opposite to the second antenna so as to protrude from the ground pattern of the antenna board, and operates as a parasitic element with respect to the first antenna.

9. The apparatus of claim 8, wherein the second protruding portion is disposed at a distance not more than substantially one tenth a wavelength corresponding to the resonant frequency from the first antenna.

10. The apparatus of claim 6, further comprising:

a first feed cable which is connected to the first feed terminal and is arranged on the ground pattern, and a second feed cable which is connected to the second feed terminal, is arranged on the ground pattern so as to be extended along one side edge of the ground pattern in a third direction opposite to the second direction to the first feed cable and have an elongated portion in parallel with the first feed cable.

11. An antenna device comprising:

an antenna board including a ground pattern;

a first feed terminal provided on the antenna board;

a first antenna including a first portion which is substantially elongated in a first direction from a first end connected to the first feed terminal to a first connecting portion, and a second portion which is substantially elongated along a second direction from the first connecting portion to a second end, the first antenna being operable in a first band including a resonant frequency;

a second feed terminal provided on the antenna board at a distance from the first feed terminal not more than substantially one quarter a wavelength corresponding to the resonant frequency of the first antenna;

a second antenna including a third portion which is substantially elongated in the first direction from a third end connected to the second feed terminal to a second connecting portion, and a fourth portion which is substantially elongated along the second direction from the second connecting portion to a fourth end, the second antenna being operable in a second band including at least the resonant frequency of the first antenna; and a first protruding portion provided at a position between the first antenna and the second antenna so as to protrude from the ground pattern of the antenna board along the first direction, the first protruding portion bypasses at least part of a current flowing through the ground pattern between the first feed terminal and the second feed terminal, wherein the first antenna is positioned with a first distance between the first portion and the first protruding portion, the second antenna is positioned with a second distance between the third portion and the first protruding portion that is shorter than the first distance, the second distance being less than or equal to one tenth a wavelength corresponding to the resonant frequency from the second antenna.

12. The device of claim 11, wherein the first feed terminal is disposed near a corner portion of the ground pattern on the antenna board;

the second feed terminal is disposed at a position on the antenna board which corresponds to a middle portion of the ground pattern; and the second portion of the first antenna and the fourth portion of the second antenna are arranged as to be parallel to one side edge of the ground pattern and the second portion of the first antenna and the fourth portion of the second antenna are directed in the second direction from the first and second connecting portions, respectively.

13. The device of claim 11, further comprising a second protruding portion which is provided at a position on a side of the first antenna which is opposite to the second antenna so as to protrude from the ground pattern of the antenna board, and operates as a parasitic element with respect to the first antenna.

14. The device of claim 13, wherein the second protruding portion is disposed at a distance not more than substantially one tenth a wavelength corresponding to the resonant frequency from the first antenna.

15. The device of claim 11, further comprising:

a first feed cable which is connected to the first feed terminal and is arranged on the ground pattern; and a second feed cable which is connected to the second feed terminal, is arranged on the ground pattern so as to be extended along one side edge of the ground pattern in a third direction opposite to the second direction to the first feed cable and have an elongated portion in parallel with the first feed cable.

* * * * *